US011376716B2

(12) United States Patent
Chang

(10) Patent No.: US 11,376,716 B2
(45) Date of Patent: Jul. 5, 2022

(54) RATCHET WRENCH

(71) Applicant: YO HAU CHANG'S ENTERPRISE CO., LTD., Taichung (TW)

(72) Inventor: Kuei-Chuan Chang, Taichung (TW)

(73) Assignee: YO HAU CHANG'S ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/013,598

(22) Filed: Sep. 6, 2020

(65) Prior Publication Data

US 2021/0107119 A1 Apr. 15, 2021

(30) Foreign Application Priority Data

Oct. 9, 2019 (TW) ..... 108213396

(51) Int. Cl.
*B25B 13/46* (2006.01)
*B25B 23/00* (2006.01)

(52) U.S. Cl.
CPC ..... *B25B 13/463* (2013.01); *B25B 23/0007* (2013.01)

(58) Field of Classification Search
CPC ..... B25B 13/463; B25B 23/0007
USPC ..... 81/60, 62, 63.1, 63.2
See application file for complete search history.

(56) References Cited

U.S. PATENT DOCUMENTS 1,031,474 A * 7/1912 Sherman ..... B25B 13/463 81/60
2,844,982 A * 7/1958 Swenson ..... B25B 19/00 173/20
3,019,682 A * 2/1962 Hare ..... B25B 13/463 74/157
3,180,185 A * 4/1965 Schmidt ..... B25B 13/463 173/93
3,184,998 A * 5/1965 Young ..... B25B 19/00 173/93.5
4,240,310 A * 12/1980 Roth ..... B25B 17/00 81/57.29
4,491,043 A * 1/1985 Dempsey ..... B25B 13/462 81/58
5,211,087 A * 5/1993 Thomason ..... B25B 13/461 81/63
5,921,158 A * 7/1999 Slusar ..... B25B 13/465 81/63

(Continued)

FOREIGN PATENT DOCUMENTS

DE 102019105567 A1 * 9/2020 ..... B25B 13/463

*Primary Examiner* — Joseph J Hail
*Assistant Examiner* — Jonathan R Zaworski
(74) *Attorney, Agent, or Firm* — Pai Patent & Trademark Law Firm; Chao-Chang David Pai

(57) ABSTRACT

A ratchet wrench has a head. The head is recessed with a driving chamber. A ratchet wheel is disposed in the driving chamber. The driving chamber is covered with a cover plate. The head further has a first shaft hole. The cover plate has a second shaft hole. Two sides of the ratchet wheel are provided with a first shaft portion inserting through the first shaft hole and a second shaft portion inserting through the second shaft hole, respectively. A bearing ring is sleeved onto the second shaft portion. An outer periphery of the bearing ring abuts against an inner wall surface of the driving chamber for positioning and lubricating the ratchet wheel, so that the ratchet wheel can rotate smoothly.

4 Claims, 6 Drawing Sheets

(56) References Cited

U.S. PATENT DOCUMENTS

| | | | | |
|---|---|---|---|---|
| 6,050,165 | A * | 4/2000 | Hall | B25B 13/461 81/58.2 |
| 6,655,237 | B2 * | 12/2003 | Chen | B25B 13/461 81/60 |
| 6,711,973 | B2 * | 3/2004 | Arnold | B25B 13/463 81/63 |
| 6,918,323 | B2 * | 7/2005 | Arnold | B25B 13/463 81/63 |
| 6,981,435 | B2 * | 1/2006 | Hsien | B25B 13/463 81/60 |
| 7,047,842 | B1 * | 5/2006 | Lee | B25B 13/463 81/63 |
| 7,263,919 | B2 * | 9/2007 | Arnold | B25B 13/463 81/60 |
| 7,299,720 | B1 * | 11/2007 | Schultz | B25B 13/463 81/62 |
| 9,032,845 | B2 * | 5/2015 | Lin | B25B 13/463 81/61 |
| 9,038,505 | B2 * | 5/2015 | He | B25B 17/00 81/57.29 |
| 9,815,179 | B2 * | 11/2017 | Anderson | B25B 13/463 |
| 2008/0271573 | A1 * | 11/2008 | Lown | B67B 7/0411 81/3.45 |
| 2017/0001286 | A1 * | 1/2017 | Hung | B25B 13/465 |

* cited by examiner

RATCHET WRENCH

FIELD OF THE INVENTION

The present invention relates to a ratchet wrench.

BACKGROUND OF THE INVENTION

A conventional ratchet wrench comprises a handle and a head formed at one end of the handle. One side of the head is recessed with an accommodating chamber. A rotatable ratchet wheel is provided in the accommodating chamber. The outer side of the accommodating chamber is covered with a cover plate. Two pawls are provided in the accommodating chamber. The pawls are connected with a direction-changing rod. The direction-changing rod is configured to operate the pawls to selectively abut against the ratchet wheel for controlling the rotation direction of the ratchet wheel.

For the ratchet wheel to rotate in the accommodating chamber, the head has a first shaft hole, and the cover plate has a second shaft hole corresponding to the first shaft hole. Two sides of the ratchet wheel are provided with a first shaft portion inserting through the first shaft hole and a second shaft portion inserting through the second shaft hole, respectively. Thereby, the ratchet wheel can rotate in the accommodating chamber.

However, when the user operates the ratchet wrench, the cover plate is likely to be slightly displaced after being stressed, and the first shaft hole and the second shaft hole are not located on the same axis, resulting in the ratchet wheel does not rotate smoothly.

SUMMARY OF THE INVENTION

The primary object of the present invention is to provide a ratchet wrench having a bearing ring to locate and lubricate a ratchet wheel so that the ratchet wheel rotates smoothly.

In order to achieve the aforesaid object, a ratchet wrench is provided. The ratchet wrench has a head. One side of the head is recessed with a driving chamber. A ratchet wheel is rotatably accommodated in the driving chamber. The driving chamber is covered with a cover plate. Another side of the head, opposite to the driving chamber, is formed with a first shaft hole communicating with the driving chamber. The cover plate has a second shaft hole corresponding to the first shaft hole. The second shaft hole communicates with the driving chamber. The ratchet wheel has an annular toothed portion. A first shaft portion and a second shaft portion are provided on two sides of the annular toothed portion. The first shaft portion is rotatably inserted through the first shaft hole. The second shaft portion is rotatably inserted through the second shaft hole. The ratchet wrench further comprises a bearing ring. The bearing ring is disposed between the ratchet wheel and the cover plate. The bearing ring has a central hole corresponding in size to a diameter of the second shaft portion for the second shaft portion to be inserted therethrough so that the bearing ring can be sleeved onto the second shaft portion of the ratchet wheel. An outer diameter of the bearing ring is greater than an outer diameter of the annular toothed portion. An outer periphery of the bearing ring abuts against an inner wall surface of the driving chamber.

In the ratchet wrench provided by the present invention, the bearing ring is sleeved onto the second shaft portion of the ratchet wheel, and the outer periphery of the bearing ring abuts against the inner wall surface of the driving chamber.

Therefore, the second shaft portion of the ratchet wheel can be positioned and lubricated by the bearing ring, so that the rotation of the ratchet wheel is smoother. On the other hand, because the bearing ring and the ratchet wheel are separate parts, there is no interference with the processing of the ratchet wheel, and the integrity of the teeth of the ratchet wheel can be maintained.

DETAILED DESCRIPTION OF THE PREFERRED EMBODIMENTS

Figure 1:
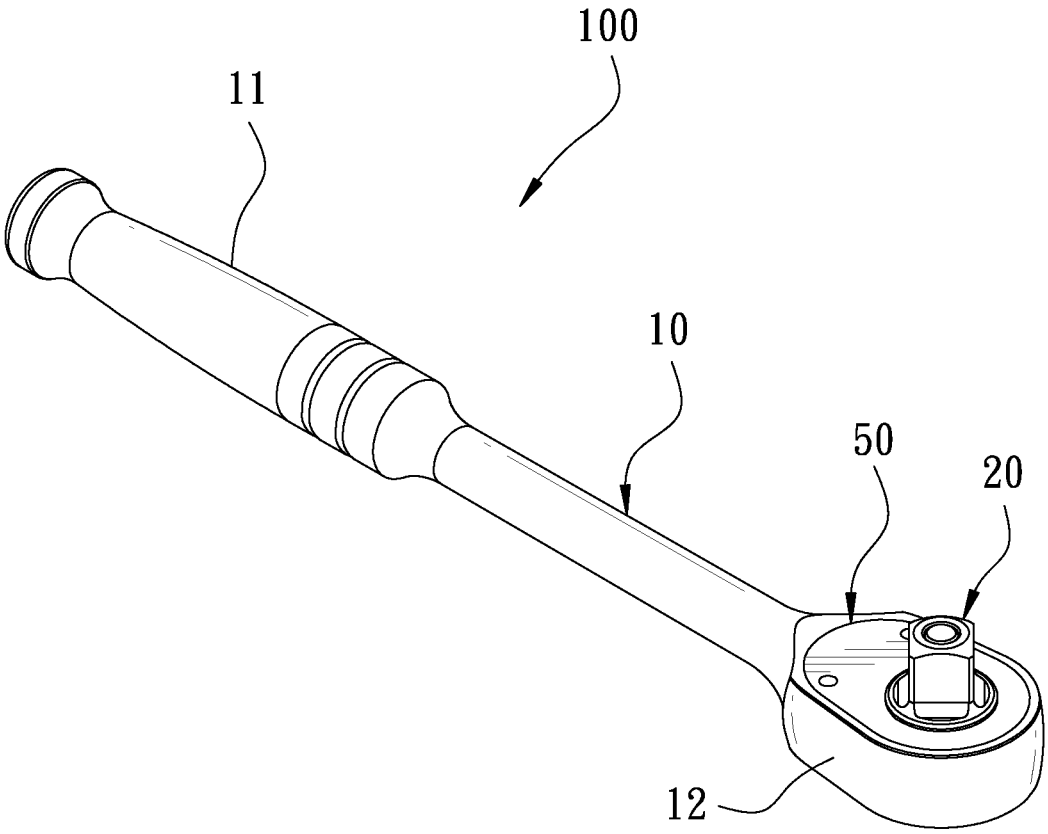
FIG. 1 is a perspective view in accordance with a preferred embodiment of the present invention.

Embodiments of the present invention will now be described, by way of example only, with reference to the accompanying drawings.

As shown in FIG. 1 through FIG. 6, the present invention discloses a ratchet wrench 100. The ratchet wrench 100 comprises a main body 10, a ratchet wheel 20, a bearing ring 30, a direction-changing unit 40, and a cover plate 50.

The main body 10 has a handle 11 and a head 12 formed at one end of the handle 11. One side of the head 12 is recessed with a driving chamber 13 and an operating chamber 14 communicating with the driving chamber 13. The other side of the head 12, opposite to the driving chamber 13, is formed with a first shaft hole 15 communicating with the driving chamber 13 and an operating hole 16 communicating with the operating chamber 14.

Figure 5:
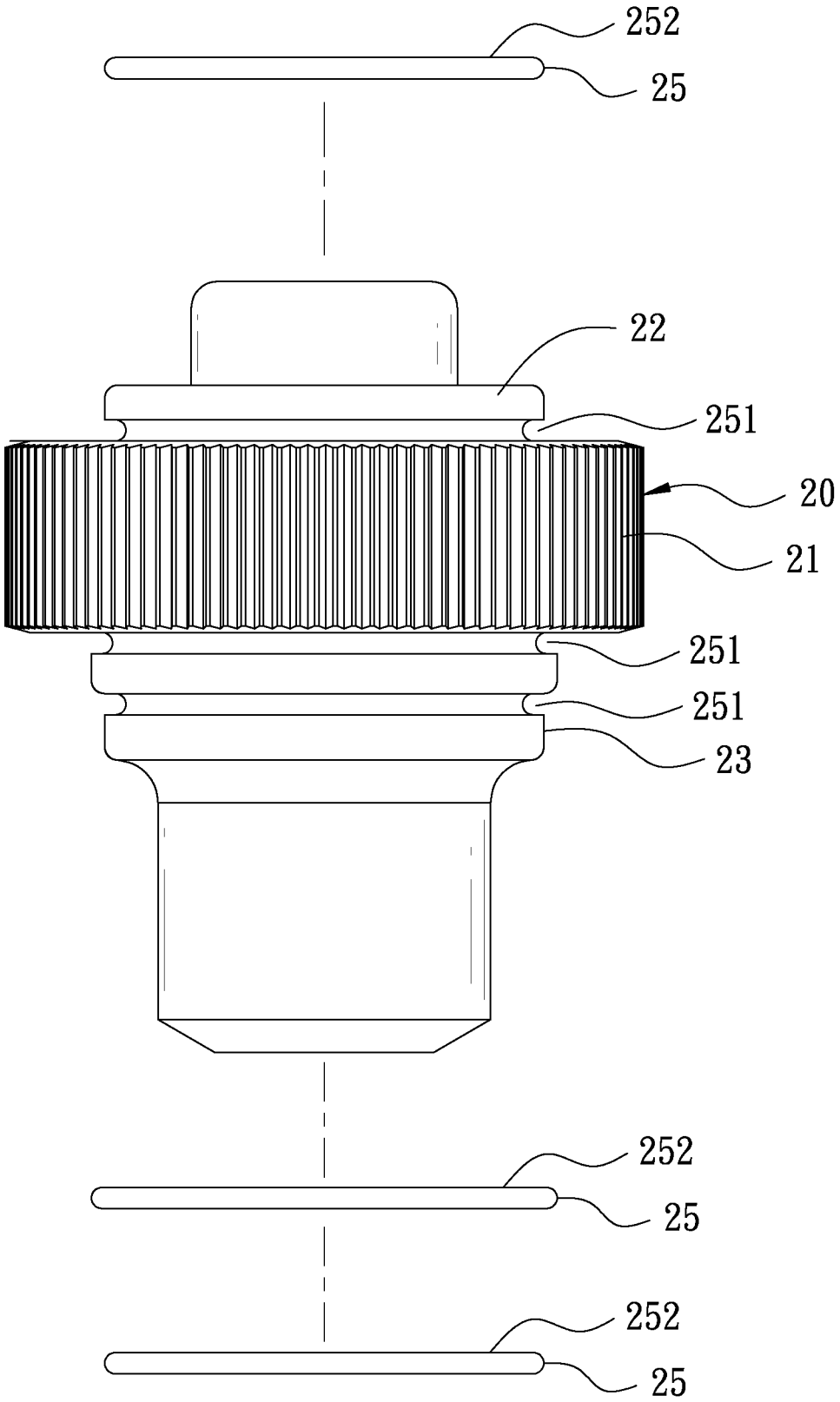
FIG. 5 is an exploded view of the ratchet wheel in accordance with the preferred embodiment of the present invention.

The ratchet wheel 20 is rotatably accommodated in the driving chamber 13. The ratchet wheel 20 has an annular toothed portion 21. A first shaft portion 22 and a second shaft portion 23 are formed symmetrically on two sides of the annular toothed portion 21. The first shaft portion 22 is rotatably inserted through the first shaft hole 15. The second shaft portion 23 has a large-diameter section 231 axially extending from the annular toothed portion 21 and a small-diameter section 232 axially extending from the large-diameter section 231. The diameter of the large-diameter section 231 is greater than the small-diameter section 232. The second shaft portion 23 is further extended with a connecting portion 24 for connecting a driven member, such as a sleeve. Referring to FIG. 5, the ratchet wheel 20 includes sealing structures 25 arranged between the first shaft portion 22 and the annular toothed portion 21, between the large-diameter section 231 and the annular toothed portion 21 and between the large-diameter section 231 and the small-diameter section 232, respectively. In this embodiment, the sealing structure 25 is composed of an annular groove 251 and a sealing ring 252 arranged in the annular groove 251.

Figure 6:
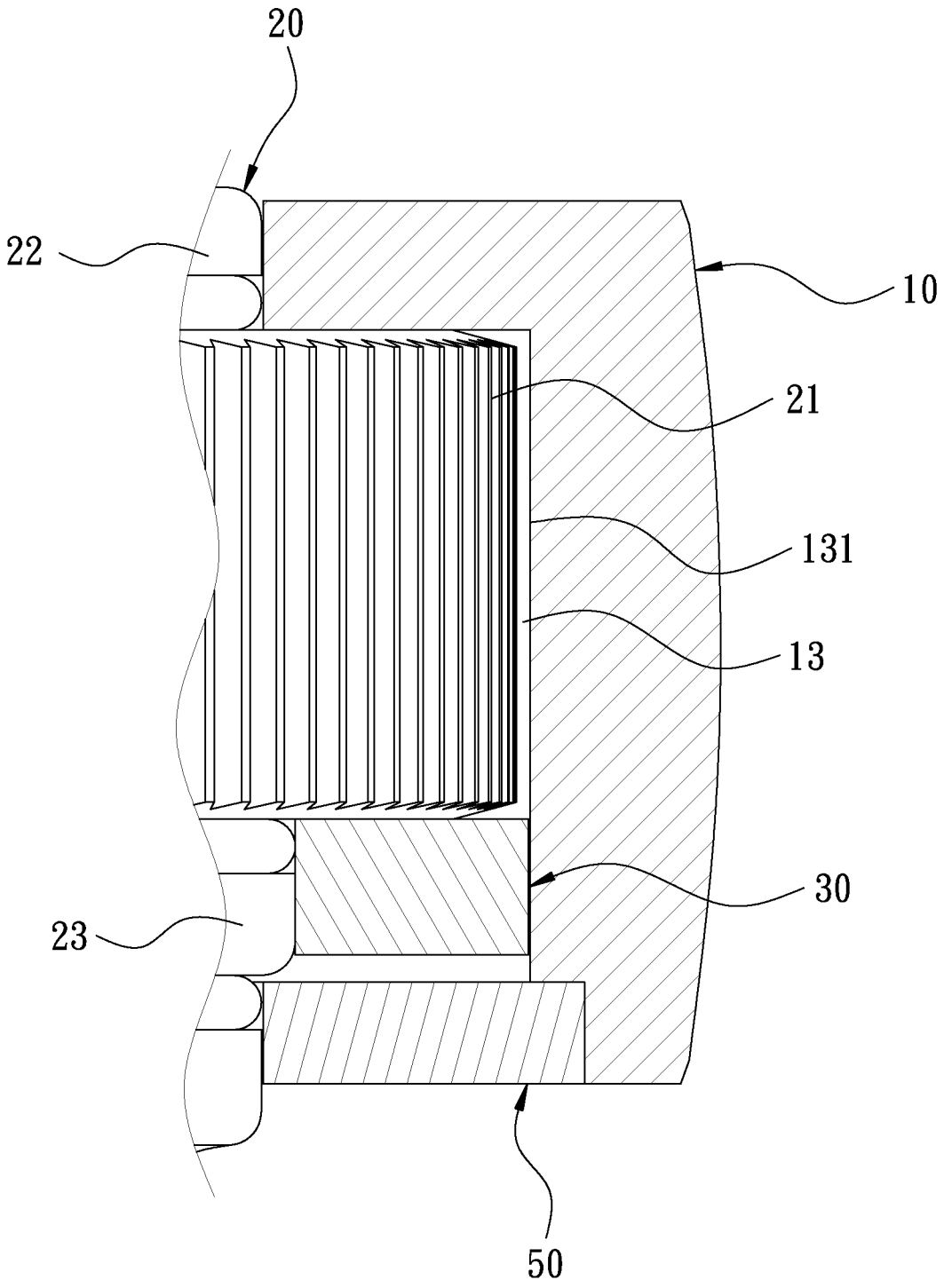
FIG. 6 is a partial enlarged cross-sectional view in accordance with the preferred embodiment of the present invention.

The bearing ring 30 is disposed in the driving chamber 13. The bearing ring 30 has a central hole 31 corresponding in size to the diameter of the second shaft portion 23 for the second shaft portion 23 to be inserted therethrough, so that the bearing ring 30 can be sleeved onto the second shaft portion 23 of the ratchet wheel 20. Referring to FIG. 6, the outer diameter of the bearing ring 30 is greater than the outer diameter of the annular toothed portion 21. The outer periphery of the bearing ring 30 abuts against the inner wall surface 131 of the driving chamber 13. In this embodiment, the bearing ring 30 is sleeved on the large-diameter section 231 of the second shaft portion 23. The bearing ring 30 may be a self-lubricating bearing, a ball bearing or a needle roller bearing.

The direction-changing unit 40 has a pawl 41 accommodated in the operating chamber 14 and a direction-changing rod 42 inserted through the operating hole 16. The direction-changing rod 42 is configured to drive the pawl 41 to selectively abut against the annular toothed portion 21 of the ratchet wheel 20. In this embodiment, one side of the direction-changing rod 42, facing the pawl 41, is recessed with an elliptical groove 421. A spring 43 and an elliptical block 44 are provided in the elliptical groove 421. The elliptical block 44 is biased by the spring 43 to elastically push the pawl 41 against the annular toothed portion 21. In this way, the elastic force of the spring 43 can push the pawl 41 evenly through the elliptical design.

The cover plate 50 is disposed on the outer sides of the driving chamber 13 and the operation chamber 14 to confine the ratchet wheel 20, the bearing ring 30 and the direction-changing unit 40 within the driving chamber 13 and the operation chamber 14. The cover plate 50 has a second shaft hole 51 corresponding to the first shaft hole 15 for the second shaft portion 23 of the ratchet wheel 20 to pass therethrough. In this embodiment, the small-diameter section 232 of the second shaft portion 23 is rotatably inserted through the second shaft hole 51.

Figure 2:
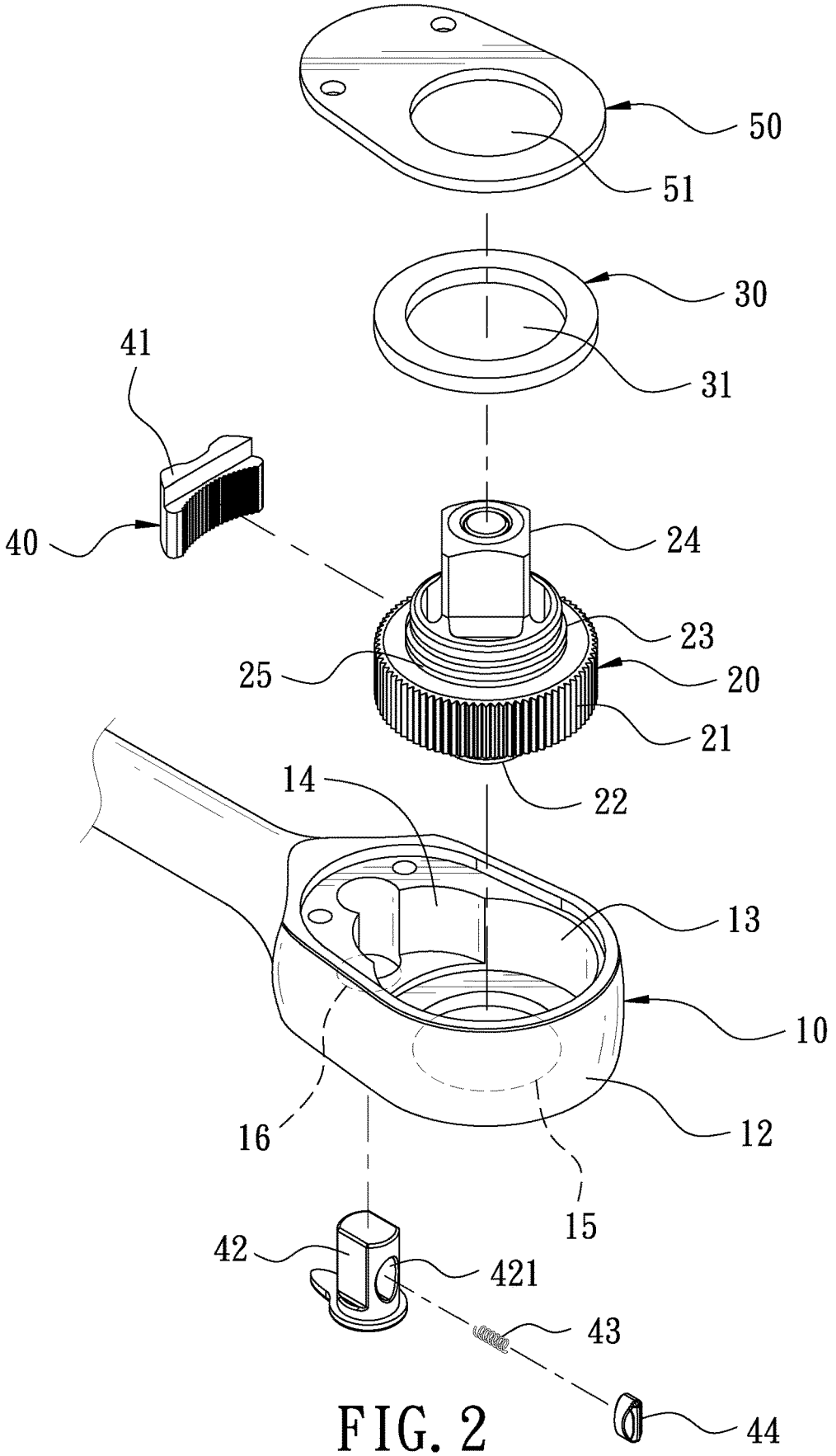
FIG. 2 is an exploded view in accordance with the preferred embodiment of the present invention.
Figure 3:
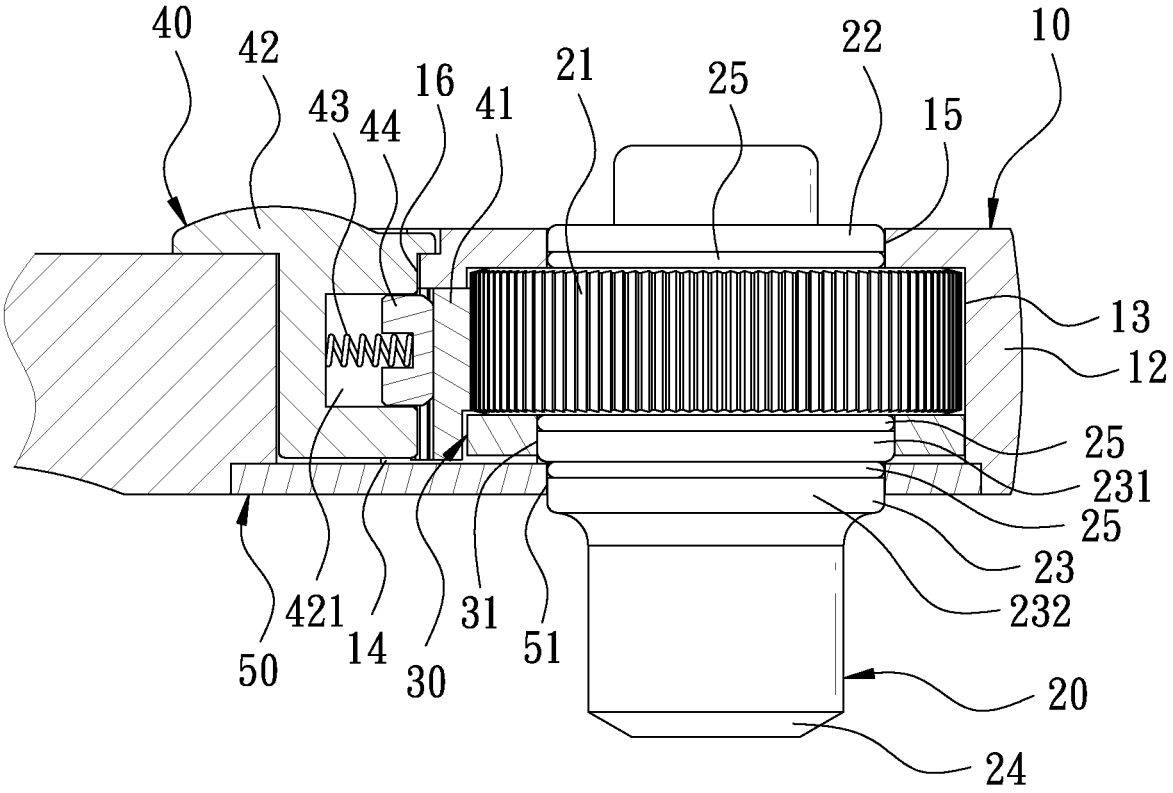
FIG. 3 is an axial cross-sectional view in accordance with the preferred embodiment of the present invention.
Figure 4:
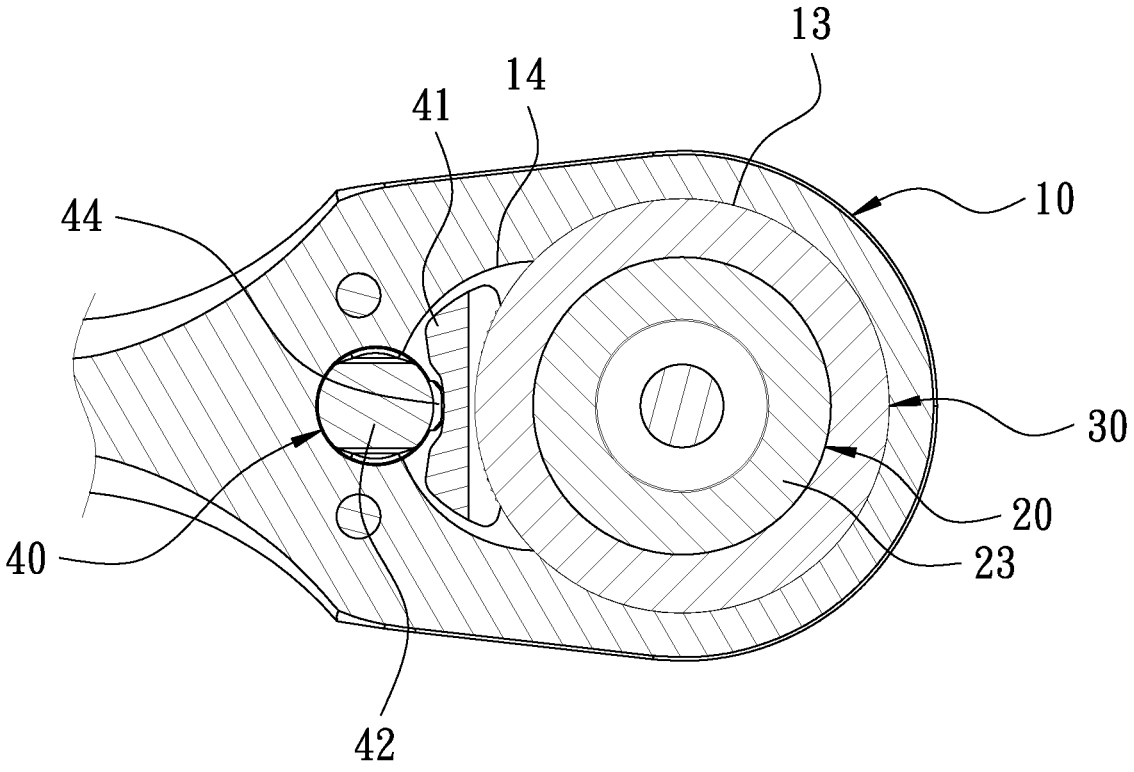
FIG. 4 is a radial cross-sectional view in accordance with the preferred embodiment of the present invention.

Referring to FIG. 2 and FIG. 3, when the ratchet wrench 100 is to be assembled, the center hole 31 of the bearing ring 30 is first fitted on the large-diameter section 231 of the second shaft portion 23 of the ratchet wheel 20. Then, the ratchet wheel 20 with the bearing ring 30 is placed into the driving chamber 13, and the first shaft portion 22 of the ratchet wheel 20 is inserted through the first shaft hole 15. After that, the pawl 41 of the direction-changing unit 40 is placed into the operating chamber 14, and then the elliptical block 44 and the spring 43 are placed into the elliptical groove 421 of the direction-changing rod 42 to be assembled in the operating hole 16. Then, the cover plate 50 covers the outer sides of the driving chamber 13 and the operating chamber 14, and the small-diameter section 232 of the second shaft portion 23 is inserted through the second shaft hole 51 to complete the assembly of the ratchet wrench 100. Thereby, when in use, the user only needs to operate the direction-changing rod 42 to drive the pawl 41 to selectively abut against the annular toothed portion 21 of the ratchet wheel 20 or not and to control the direction of rotation. This operation is general knowledge, so it won't be described hereinafter. The present invention emphasizes that, as shown in FIG. 5, the second shaft portion 23 of the ratchet wheel 20 is sleeved with the bearing ring 30, and the outer periphery of the bearing ring 30 abuts against the inner wall surface 131 of the driving chamber 13. Therefore, the second shaft portion 23 of the ratchet wheel 20 can be positioned and lubricated by the bearing ring 30, so that the ratchet wheel 20 can rotate smoothly.

It is worth mentioning that because the bearing ring 30 and the ratchet wheel 20 are two separate parts, when the teeth of the ratchet wheel 20 are processed, they will not be interfered by the bearing ring 30 and the teeth can be formed completely. This design ensures that the strength of the teeth is not reduced. The number of teeth of the ratchet wheel 20 may be greater than 72, such as 108 or 144.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ratchet wrench comprising:

a head, one side of the head being recessed with a driving chamber, another side of the head, opposite to the driving chamber, being formed with a first shaft hole communicating with the driving chamber;

a cover plate covering the driving chamber, the cover plate having a second shaft hole corresponding to the first shaft hole, the second shaft hole communicating with the driving chamber;

a ratchet wheel rotatably accommodated in the driving chamber, the ratchet wheel having an annular toothed portion, a first shaft portion and a second shaft portion provided on two sides of the annular toothed portion, the first shaft portion being rotatably inserted through the first shaft hole, the second shaft portion being rotatably inserted through the second shaft hole; and a bearing ring disposed between the ratchet wheel and the cover plate, wherein the bearing ring is neither connected to nor embedded in the cover plate and has a central hole corresponding in size to a diameter of the second shaft portion for the second shaft portion to be inserted therethrough so that the bearing ring is sleeved onto the second shaft portion of the ratchet wheel, an outer diameter of the bearing ring is greater than an outer diameter of the annular toothed portion, and an outer periphery of the bearing ring abuts against an inner wall surface of the driving chamber, wherein the second shaft portion has a large-diameter section axially extending from the annular toothed portion and a small-diameter section axially extending from the large-diameter section, the large-diameter section is inserted in the central hole of the bearing ring, and the small-diameter section is inserted in the second shaft hole.

2. The ratchet wrench as claimed in claim 1, wherein the ratchet wheel further includes sealing structures arranged between the first shaft portion and the annular toothed portion, between the large-diameter section and the annular toothed portion and between the large-diameter section and the small-diameter section, respectively.

3. The ratchet wrench as claimed in claim 2, wherein each of the sealing structures is composed of an annular groove and a sealing ring arranged in the annular groove.

4. The ratchet wrench as claimed in claim 1, wherein the bearing ring is a self-lubricating bearing.

* * * * *